United States Patent [19]

Green

[11] 3,973,263

[45] Aug. 3, 1976

[54] SENSITIVITY IMPROVEMENT OF SPACED-LOOP ANTENNA BY CAPACITIVE GAP LOADING

[75] Inventor: Terence C. Green, San Antonio, Tex.

[73] Assignee: The United States of America as represented by the Secretary of the Navy, Washington, D.C.

[22] Filed: Apr. 20, 1973

[21] Appl. No.: 353,143

[52] U.S. Cl. ..... 343/744; 343/748; 343/842

[51] Int. Cl.[2] ..... H01Q 7/04

[58] Field of Search ..... 343/841, 842, 744, 748

[56] References Cited

UNITED STATES PATENTS

| | | | |
|---|---|---|---|
| 2,426,632 | 9/1947 | Marchand | 343/726 |
| 3,329,954 | 7/1967 | Travers | 343/842 |

FOREIGN PATENTS OR APPLICATIONS

| | | | |
|---|---|---|---|
| 871,799 | 5/1942 | France | 343/842 |
| 902,021 | 1/1954 | Germany | 343/842 |

*Primary Examiner*—Eli Lieberman

*Attorney, Agent, or Firm*—R. Sciascia; R. Beers; S. Sheinbein

[57] ABSTRACT

An improved antenna system having a plurality of loop antennas surrounded by coaxial shields which have dual electrostatic shield gaps therein. A shunt capacitance is placed across each of the shield gaps. The shunt capacitances are matched and variable among discrete values. Variation of the capacitances provides increased antenna sensitivity without a change in physical dimensions of the antenna.

4 Claims, 4 Drawing Figures

SENSITIVITY IMPROVEMENT OF SPACED-LOOP ANTENNA BY CAPACITIVE GAP LOADING

BACKGROUND OF THE INVENTION

The present invention relates generally to antenna systems and more particularly to a technique for improving the sensitivity of spaced-loop antenna systems.

Spaced-loop antenna systems inherently have reduced sensitivity (antenna pickup) at the low end of their design frequency range. It is desirable to utilize techniques to provide increased spaced-loop antenna sensitivity without changing antenna physical dimensions. Such a technique should be applicable for both tuned and untuned crossed, spaced-loop antennas.

SUMMARY OF THE INVENTION

The present invention increases the sensitivity of spaced-loop antenna systems at the low end of their design frequency range, by placing discrete (i.e., lumped) capacitance values across each of the electrostatic shield gaps of a spaced-loop antenna system. The capacitance values are varied to provide increased antenna sensitivity. The invention is also applicable to crossed, spaced-loop antenna systems.

An object of the present invention is to increase the sensitivity of a spaced-loop antenna.

Another object of the invention is to increase the sensitivity of a spaced-loop antenna while maintaining the physical dimensions of the antenna system.

Other objects, advantages and novel features of the present invention will become apparent from the following detailed description when considered in conjunction with the accompanying drawings.

DESCRIPTION OF THE PREFERRED EMBODIMENTS

Figure 1:
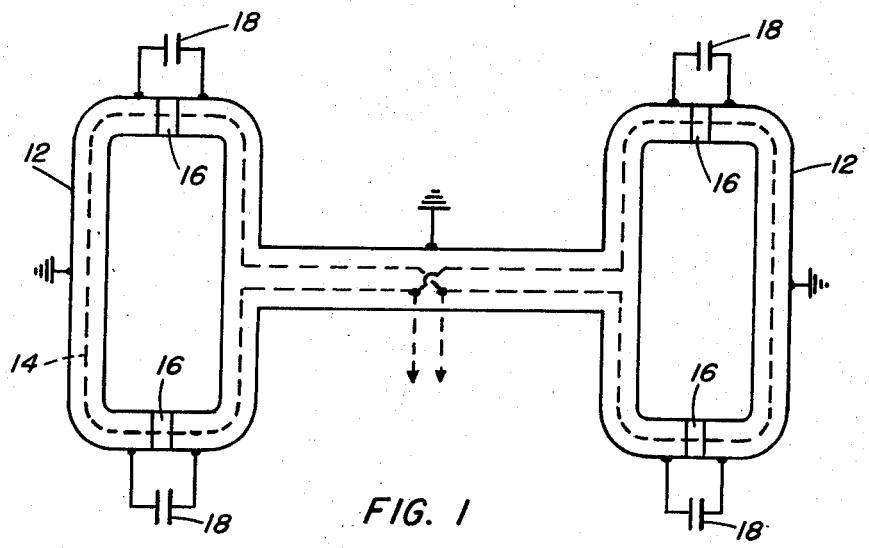
FIG. 1 is a schematic of a coaxial, dual, spaced-loop, antenna system employing the present invention.

FIG. 1, which illustrates a preferred embodiment of the invention, shows a coaxial spaced-loop antenna system, including two shielded loop antennas. Each of the loops is preferably in the form of a coaxial line having an inner conductor 14 and an outer shield 12 with shield gaps 16 disposed at the top and bottom thereof or otherwise symmetrically disposed in relation to the two halves of the shield loop antenna. The shield 12 is a conductive metal, for example copper, or aluminum and constitutes an electrostatic shield for the antenna leads. The shield gaps 16 are an insulating material. For example, a cylindrical phenolic insert may be employed for the gaps 16. The antenna lead is comprised of bare copper wire and is passed continuously through each of the loops or frame components. The bare wires being indicated by the broken line 14.

Matched discrete capacitance values, represented by capacitors 18, that is, capacitors of substantially the same values are placed across the electrostatic shield gaps 16 to provide sensitivity enhancement. For shunt capacitance values from 0 to 6800 pf of the antenna sensitivity for a 20 inch × 40 inch × 60 inch single-turn coaxial spaced loop is improved from nominally 450$\mu$v/m to 55 $\mu$v/m (corresponding to a spaced loop pick up factor improvement of greater than 8:1). Sensitivity improves as the capacitance is increased across the gap until a resonant capacitance value is reached. Additional capacitance gap loading beyond the resonant point decreases antenna sensitivity and ultimately results in deterioriated antenna patterns. The upper antenna bandwidth, using capacitive loaded gaps, is also limited since, as frequency increases, the capacitive reactance across each gap is reduced to a value at which complete electromagnetic shielding of the inner loop begins to occur. The discrete capacitance placed across the gap may be defined as a capacitive network, and such network may contain as few as one discrete capacitive element.

Figure 2:
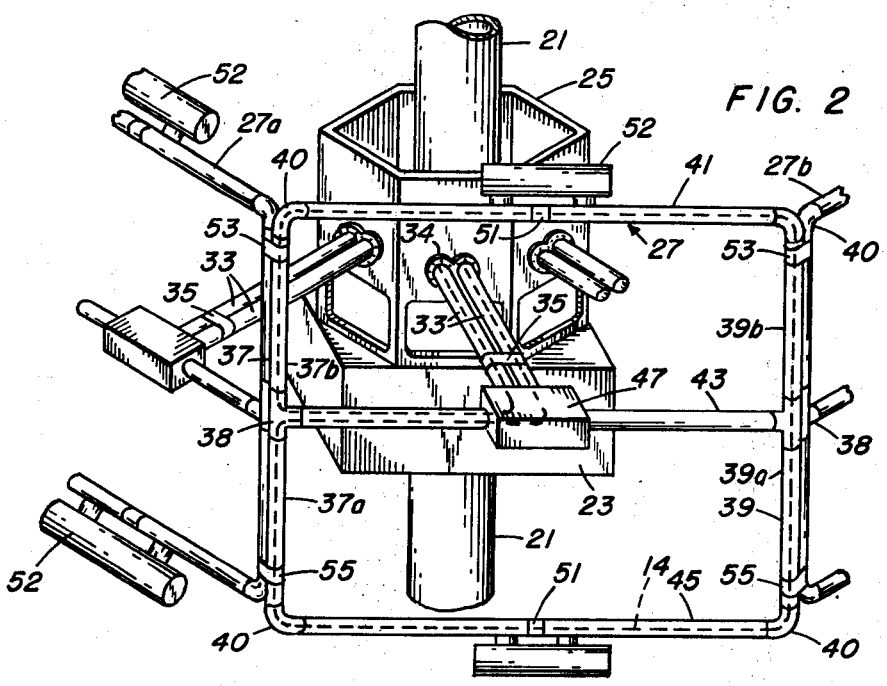
FIG. 2 is a view in perspective of an eight-loop, crossed spaced-loop antenna employing the present invention.

FIG. 2 is a perspective view of an eight-loop, crossed, spaced-loop antenna modified by the addition of the present invention. The antenna itself is fully disclosed in U.S. Pat. No. 3,329,954, which disclosure is incorporated herein.

On an upstanding central support such as a radar mast 21 on board a ship, there is provided a mounting platform 23 attached or secured in any suitable manner (not shown) to the mast 21 so that the mast passes through the center of the platform. Securely fastened in any suitable manner (not shown) to the top of the mounting platform 23 surrounding the mast or support 21 is a feed box 25 which contains the terminal receiver equipment for the antenna. The feed box 25 may conveniently take the form of an octagonal parallelepiped made of rigid material and upstandingly oriented on the mounting platform 23. The walls of the feed box 25 may be made of any suitable strong material such as metal, for example, type K rigid copper tubing or type 6061 aluminum sheet.

Figure 3:
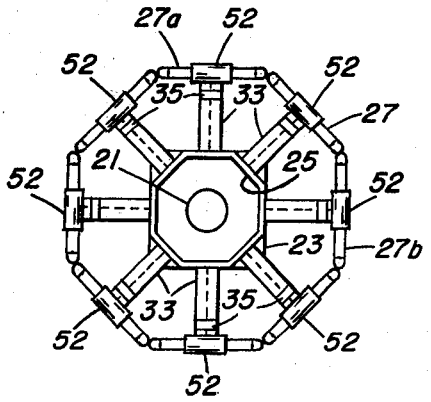
FIG. 3 is a schematic view of the antenna shown in FIG. 2 physically oriented about a ships mast.

The physical orientation of the loops about feed box 25 and mass 21 may best be seen in FIG. 3. Since each loop is identical in construction to each of the other loops, only one of the loops shown in FIG. 2 need be described in detail. The loop to be described in detail is given the reference number 27, and its adjacent loops the reference numerals **27*a* and 27*b*. For supporting each of the identical loops, there is rigidly mounted a pair of transverse metallic shielding tubes 33, extending transversely outwardly from an anchoring base member 34 bolted or welded to a wall of the feed box 25, the base member 34 shown in FIG. 2 as being bolted to feed box 25. Each pair of tubes 33 may be secured together in any suitable manner by means of a metal band 35** tack welded to assure electrical continuity between the tubes.

In construction, each of the loops such as loop 27 is shown as being made of metallic tubular material or tubes and as having a generally rectangular shape or configuration. This rectangular configuration is formed in part by opposing vertical legs or ends 37 and 39. The legs 37 and 39 are each comprised of two substantial identical tubular sections **37*a*–37*b* and 39*a*–39*b*, and the tubular sections are held in axial alignment and in rigid assembly by means of tubular T-joints 38. The tubular vertical ends or legs 37 and 39 are rigidly connected by suitable elbow joints 40 to an upper horizontal support tube 41, to intermediate support tube 43, and to a lower horizontal support tube 45. There is thus formed by the foregoing tube components a substantially rectangular tubular frame member or frame having an intermediate horizontal support tube. The intermediate horizontal support tube 43 has rigidly attached to its central portion a hollow metallic mounting box 47. The hollow mounting box 47 is rigidly connected by any suitable rigid joint means (not shown) to the extremities of the pair of tubes 33 and is, therefore, rigid therewith. The intermediate support tube 43 is also rigidly connected to the mounting box 47 so the tubes 33 rigidly support the entire loop 27.**

Each of the metallic frame components 37, 39, 41, 43 and 45 in this one embodiment of the invention is made of copper or aluminum and constitutes an electrostatic shield for the antenna lead 14. Each of the junctions between the various joints (T-joints 38, elbow joints 40, and mounting box 47) and the tubular sections 37, 39, 41, 43 and 45, as appropriate, are welded joints assuring continuous electrical continuity. In the central portion of the upper and lower tubes 41 and 45, there is disposed insulating gaps 51 which may be filled with any suitable insulating material. For example, a cylindrical phenolic insert may be employed for the gaps 51.

The antenna lead itself is comprised of bare copper wire which is passed continuously through each of the loops or frame components. The wire is indicated by the broken line 14. In passng continuously through the frame components, the wire also extends substantially coaxial with each frame component.

The present invention improves the sensitivity of the eight-loop array shown in FIGS. 2 and 3. A capacitive, gap-loading, circuit assembly 52 is mounted across each of the shield gaps 51 on the crossed, spaced-loop antenna. Eight discrete capacitors ranging from 500 to 6800 pf were used in each of the assemblies. All capacitance values were carefully matched to ensure uniformity from assembly to assembly. Identical circuit assemblies should be fabricated to accomodate all the gaps 51 in the crossed, spaced-loop antenna.

Figure 4:
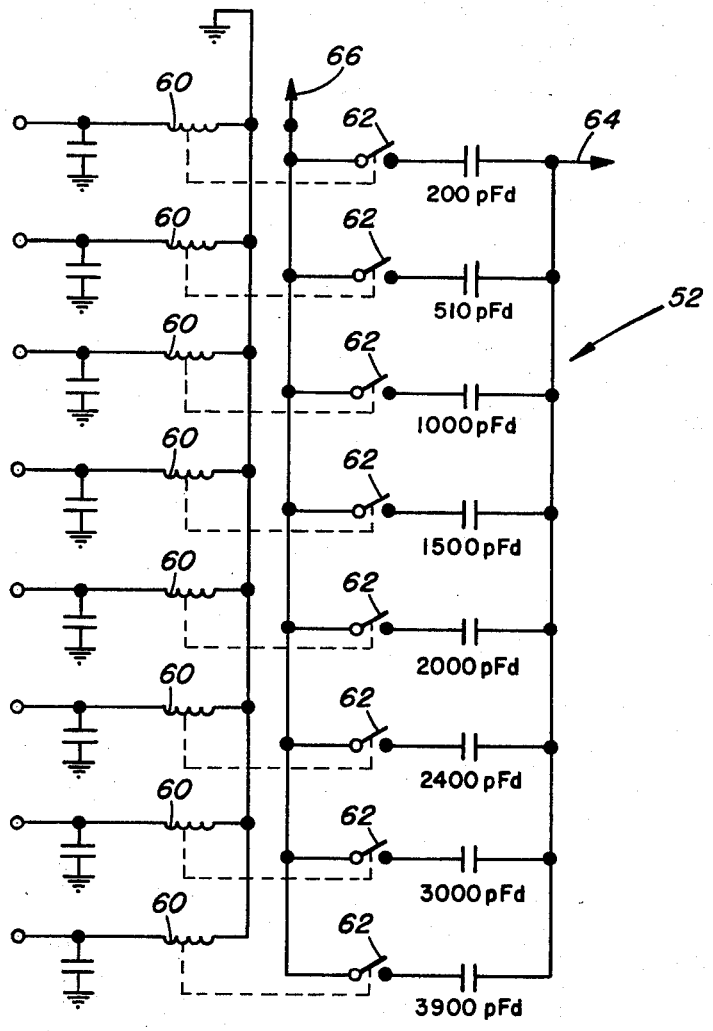
FIG. 4 is a schematic of one possible capacitive, gap-loading circuit.

A typical circuit is illustrated in FIG. 4. Each circuit provides the capability of remotely switching one of eight discrete capacitance values across the gap. Relays 60–62 are employed to impose discrete capacitance values across the electrostatic shield gaps 51. Contacts 66 and 64 are connected to the coaxial shields on either side of the shield gaps 51. Various control cables (not shown) are also mounted on the antenna to actuate individual relays 60–62 to impose discrete capacitance values across the shield gaps 51.

The capacitive gap loading of the crossed, spaced-loop antenna provides a technique for sensitivity enhancement, particularly on the low end of the design frequency range. Sensitivity enhancement on the order of 8:1 can be realized by capacitive gap loading alone. The combination of capacitive gap loading and spaced-loop, terminal shunt capacitance tuning can provide sensitivity enhancement in the order of 24:1 or greater over narrow tuning bandwidths.

Obviously, many modifications and variations of the present invention are possible in light of the above teachings. It is therefore to be understood that, within the scope of the appended claims, the invention may be practiced otherwise than as specifically described.

What is claimed is:

1. In a shielded, coaxial, spaced-loop antenna having a plurality of gaps in its shield, the improvement comprising:

a capacitance network individual to and across each gap, each said network having substantially the same value, whereby increased sensitivity is achieved at a predetermined frequency, all networks having an equal number of corresponding capacitor elements, corresponding elements of different networks having substantially the same value; and means associated with each network for selectively connecting each element individually and across each of said shield gaps.

2. In a shielded, eight-loop, crossed, spaced-loop antenna having a plurality of gaps in its shield, the improvement comprising:

a capacitance network individual to and across each gap, each said network having substantially the same value, whereby increased sensitivity is achieved at a predetermined frequency, all networks having an equal number of corresponding capacitor elements, corresponding elements of different networks having substantially the same value; and means associated with each network for selectively connecting each element individually and across each of said shield gaps.

3. In a shielded, coaxial, spaced-loop antenna, having a plurality of gaps in its shield, the improvement comprising:

a capacitance network individual to and across each gap, each said network having substantially the same value, whereby increased sensitivity is achieved at a predetermined frequency, said value of said capacitance being at or near the value which causes resonance of the shield of each shield loop to occur at said predetermined frequency.

4. In a shielded, coaxial, spaced-loop antenna having a plurality of gaps in its shield, the improvement comprising:

a capacitance network individual to and across each gap, each said network having substantially the same value, whereby increased sensitivity is achieved at a predetermined frequency, all networks having an equal number of corresponding capacitor elements, corresponding elements of different networks having substantially the same value; and means associated with each network for selectively connecting each element individually and across each of said shield gaps, said value of each said capacitance network being at or near the value which causes resonance of each shield loop to occur at said predetermined frequency.

* * * * *